US009954319B2

(12) United States Patent
Zhao

(10) Patent No.: US 9,954,319 B2
(45) Date of Patent: Apr. 24, 2018

(54) ELECTRICAL CONNECTOR ASSEMBLY

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/611,807

(22) Filed: Jun. 2, 2017

(65) Prior Publication Data

US 2017/0352990 A1 Dec. 7, 2017

(30) Foreign Application Priority Data

Jun. 2, 2016 (CN) ..... 2016 1 0382315

(51) Int. Cl.

| | |
|---|---|
| ***H01R 24/00*** | (2011.01) |
| ***H01R 13/6591*** | (2011.01) |
| ***H01R 13/10*** | (2006.01) |
| ***H01R 24/64*** | (2011.01) |
| *H01R 107/00* | (2006.01) |

(52) U.S. Cl.

CPC ..... *H01R 13/6591* (2013.01); *H01R 13/10* (2013.01); *H01R 24/64* (2013.01); *H01R 2107/00* (2013.01)

(58) Field of Classification Search

CPC ..... H01R 23/7073; H01R 23/725; H01R 23/7068; H01R 23/6873; H01R 13/658

USPC ..... 439/660.79, 607.35, 0.4, 0.27, 0.55

See application file for complete search history.

(56) References Cited

U.S. PATENT DOCUMENTS

| | | | | |
|---|---|---|---|---|
| 9,011,178 | B2 * | 4/2015 | Hori | H01R 13/6581 29/842 |
| 9,231,356 | B1 | 1/2016 | Ju et al. | |
| 9,318,856 | B2 | 4/2016 | MacDougall et al. | |
| 9,337,581 | B1 * | 5/2016 | Dong | H01R 13/64 |
| 9,425,560 | B1 * | 8/2016 | Su | H01R 13/6591 |
| 9,484,679 | B2 | 11/2016 | Guo et al. | |
| 2009/0124134 | A1 * | 5/2009 | Moriyama | H01R 13/26 439/660 |

(Continued)

FOREIGN PATENT DOCUMENTS

| | | |
|---|---|---|
| CN | 204696369 | 10/2015 |
| CN | 204809443 | 11/2015 |

(Continued)

*Primary Examiner* — Hien Vu

(74) *Attorney, Agent, or Firm* — Wei Te Chung; Ming Chieh Chang

(57) ABSTRACT

An electrical connector assembly includes: a plug connector including an insulative housing, plural conductive terminals arranged in two rows and affixed to the insulative housing, and a metal shell enclosing the insulative housing, the insulative housing comprising a top wall having plural first grooves, and each conductive terminal comprising a fixed portion affixed to a corresponding first groove and exposed to the metal shell; and a receptacle connector including an insulative body, plural mating terminals affixed to the insulative body, and a shielding shell enclosing the insulative body, the shielding shell having a tuber extending inwardly; wherein the tuber resists against a surface of the metal shell when the plug connector is mated with the receptacle connector.

8 Claims, 8 Drawing Sheets

(56) References Cited

U.S. PATENT DOCUMENTS

| | | | |
|---|---|---|---|
| 2015/0171562 | A1 | 6/2015 | Gao et al. |
| 2015/0229077 | A1 | 8/2015 | Little et al. |
| 2015/0295362 | A1 | 10/2015 | Tziviskos et al. |
| 2016/0020569 | A1 | 1/2016 | Ju et al. |

FOREIGN PATENT DOCUMENTS

| | | |
|---|---|---|
| TW | M512249 | 11/2015 |
| TW | M517434 | 2/2016 |
| TW | M517453 | 2/2016 |

* cited by examiner

ELECTRICAL CONNECTOR ASSEMBLY

BACKGROUND OF THE DISCLOSURE

1. Field of the Disclosure

The present disclosure relates to an electrical connector assembly, and more particularly to an electrical connector assembly adapted for normally and reversely mating.

2. Description of Related Arts

China Patent No. 204809443 discloses a reversible or dual orientation USB Type-C plug connector comprising an insulative housing and a plurality of elastic terminals affixed to the insulative housing in two rows. The insulative housing comprises a base portion, an annular wall extending from one side of the base portion and a slot for inserting. The annular wall comprises a first wall and a second wall. The slot is located between the first wall and the second wall. The plug connector does not have an outer shell and an EMI spring for grounding and structural strength.

China Patent No. 204243350 discloses a reversible or dual orientation USB Type-C connector comprising an insulative housing, a plurality of terminals affixed to the insulative housing, a conductive sheet affixed to the insulative housing and an outer shell. The conductive sheet comprises a fixed portion, a supporting portion bending from the fixed portion and a first contacting portion extending forwardly from the fixed portion and connecting with a mating connector. The supporting portion resists the outer shell to form a connecting point making the first contacting portion connecting with the mating connector more firmly. The connector has no grounding structure for grounding function.

An improved electrical connector is desired.

SUMMARY OF THE DISCLOSURE

Accordingly, an object of the present disclosure is to provide an electrical connector assembly ensuring a good grounding function while having a simple structure.

To achieve the above object, an electrical connector assembly comprises: a plug connector comprising an insulative housing, a plurality of conductive terminals arranged in two rows and affixed to the insulative housing, and a metal shell enclosing the insulative housing, the insulative housing comprising a top wall having a plurality of first grooves, and each conductive terminal comprising a fixed portion affixed to a corresponding first groove and exposed to the metal shell; and a receptacle connector comprising an insulative body, a plurality of mating terminals affixed to the insulative body, and a shielding shell enclosing the insulative body, the shielding shell having a tuber extending inwardly; wherein the tuber resists against a surface of the metal shell when the plug connector is mated with the receptacle connector.

Other objects, advantages and novel features of the disclosure will become more apparent from the following detailed description when taken in conjunction with the accompanying drawings.

DETAILED DESCRIPTION OF THE PREFERRED EMBODIMENT

Reference will now be made in detail to the embodiments of the present disclosure. Referring to FIGS. 1 to 8, an electrical connector assembly is affixed to a printed circuit board 300. The electrical connector assembly includes a plug connector 100 and a receptacle connector 200 adapted for normally and reversely mating with the plug connector 100. The plug connector 100 mates the receptacle connector 200 in a front-to-rear direction. The electrical connector assembly defines a transverse direction perpendicular to the front-to-rear direction and a vertical direction perpendicular to the transverse direction and the front-to-rear direction.

Figure 4:
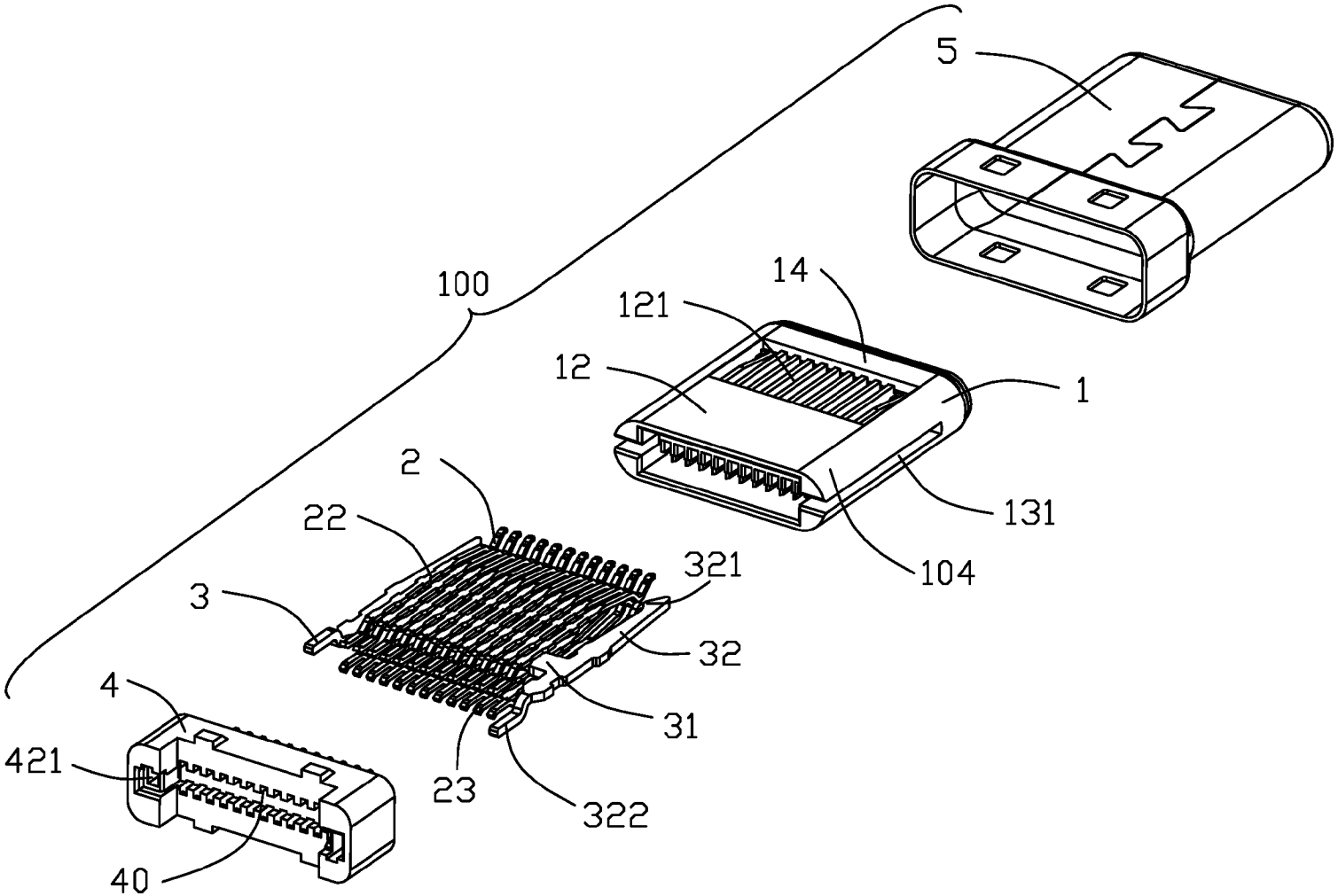
FIG. 4 is another exploded view of the plug connector taken from FIG. 3.
Figure 5:
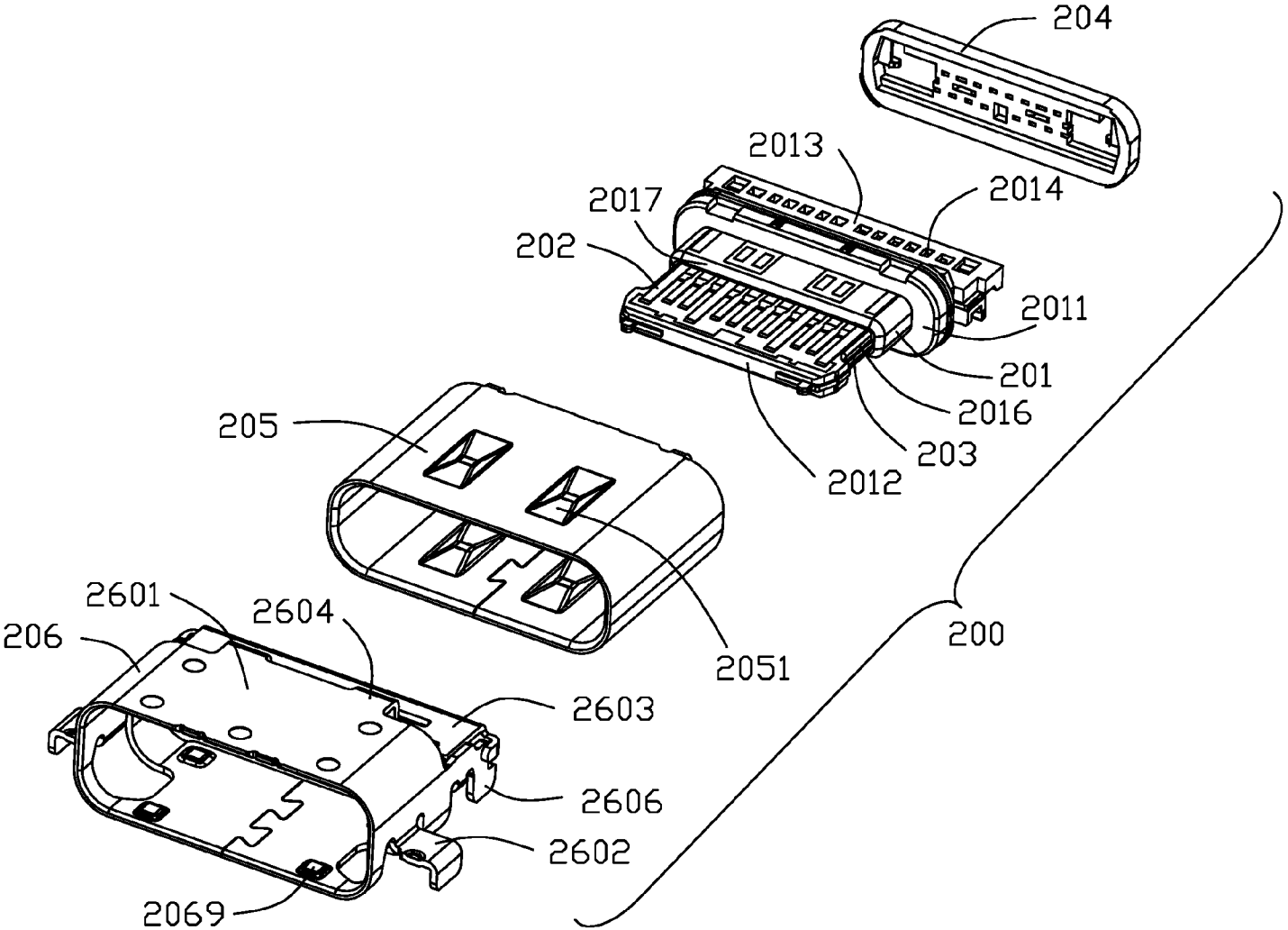
FIG. 5 is an exploded view of a receptacle connector of the electrical connector assembly.

Referring to FIGS. 4 and 5, the plug connector 100 includes: an insulative housing 1, a number of conductive terminals 2 affixed to the insulative housing 1 and isolated in two rows in the vertical direction, a locking member 3 located between the conductive terminals 2 in two rows and engaged with the receptacle connector 200, an insulator 4 located behind the insulative housing 1, and a metal shell 5 enclosing the insulative housing 1.

Figure 1:
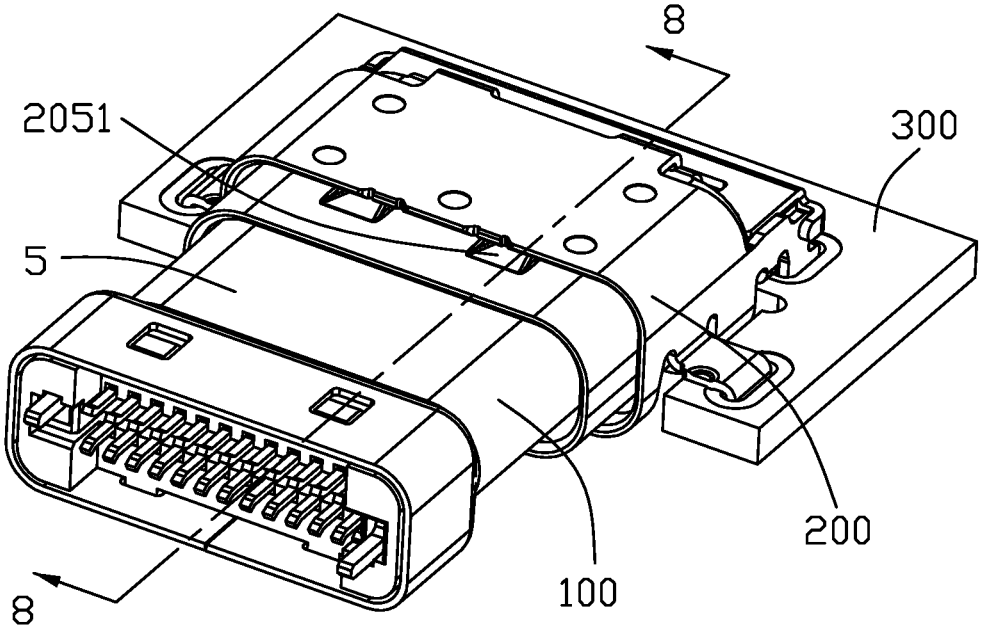
FIG. 1 is a perspective, assembled view of an electrical connector assembly.
Figure 2:
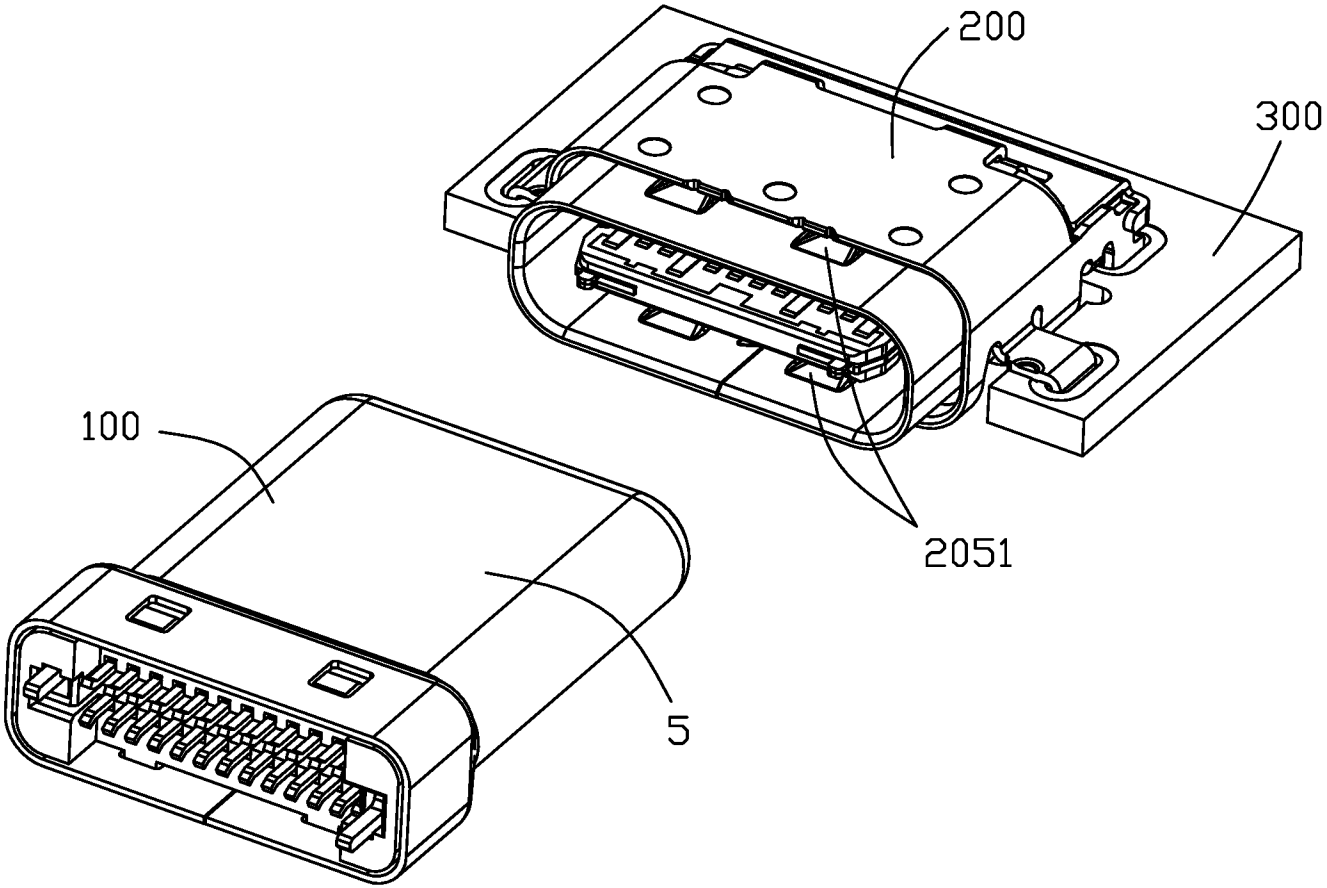
FIG. 2 is a perspective, assembled view of a plug connector and a receptacle connector of the electrical connector assembly when the plug connector is not mated with the receptacle connector.
Figure 3:
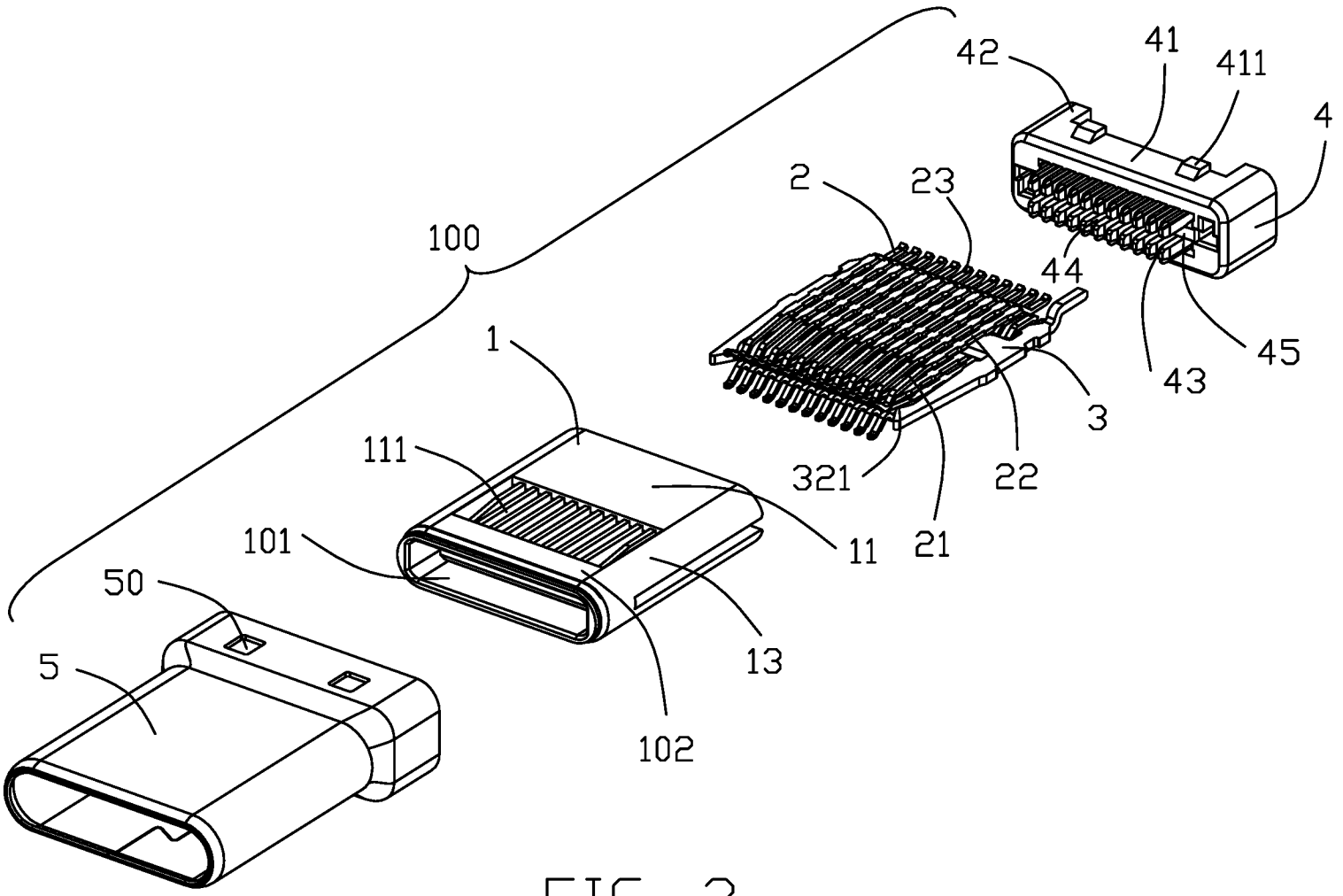
FIG. 3 is an exploded view of the plug connector.
Figure 8:
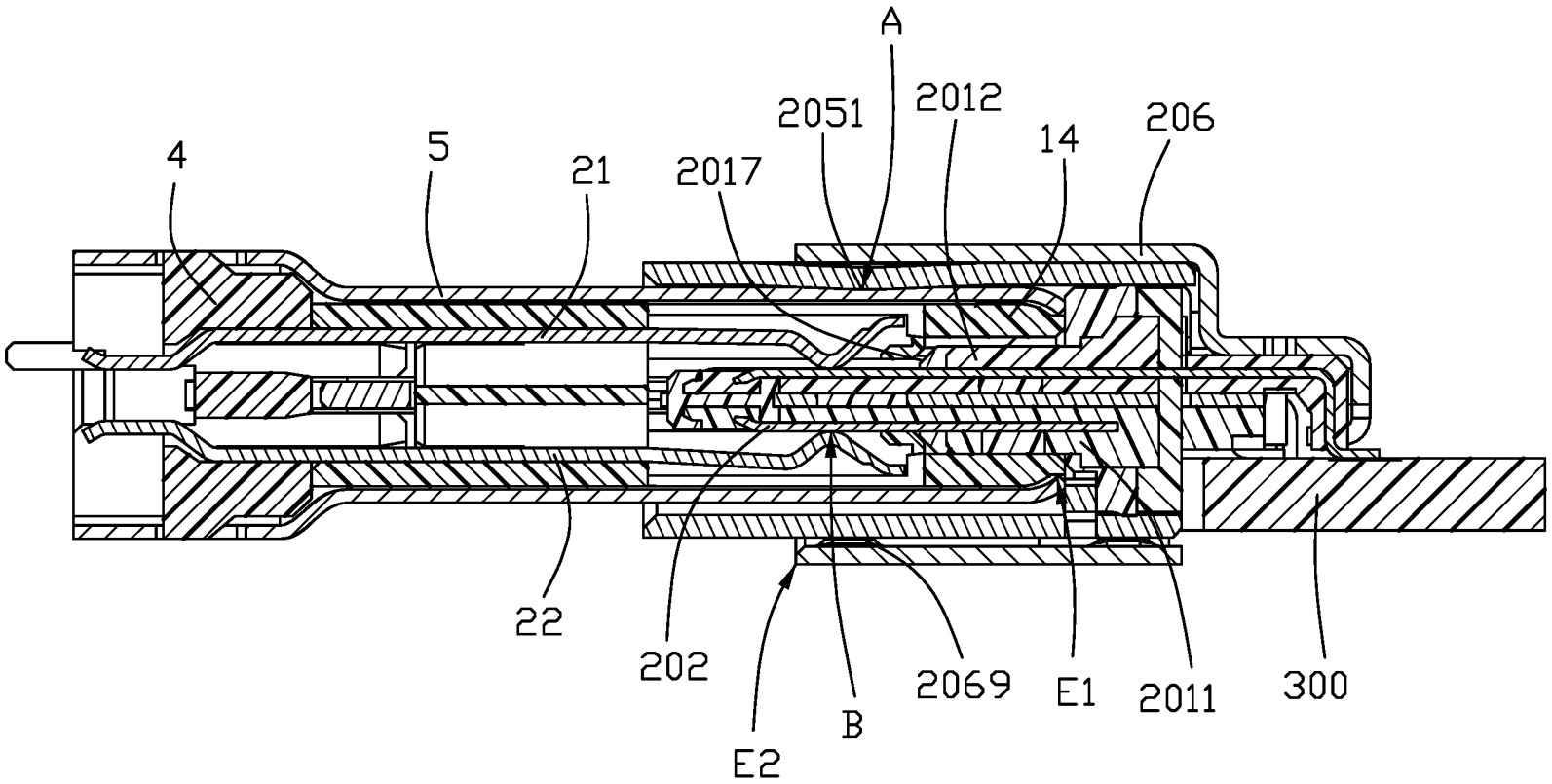
FIG. 8 is a cross-sectional view of the electrical connector assembly taken along line 8-8 in FIG. 1.

Referring to FIGS. 3-4 and 8, the insulative housing 1 includes a top wall 11, a bottom wall 12 opposite to the top wall 11 and a pair of lateral walls 13 connecting the top wall 11 and the bottom wall 12 to form a receiving room 10. The insulative housing 1 further includes a front portion 102 having a front opening 101 and a rear portion 104 having a rear opening 103. The receiving room 10 is divided into the front portion 102 and the rear portion 104. The top wall 11 includes a number of first grooves 111 located in a front end of the top wall 11 and communicating with the front portion 102. The bottom wall 12 includes a number of second grooves 121 located in a front end of the bottom wall 12 and communicating with the front portion 102. The lateral walls 13 include a pair of third grooves penetrating a rear end of the lateral walls 13 and extending forwardly. The insulative housing 1 includes a pair of insulative walls 14 located in front of the first grooves 111 and the second grooves 121. The annular wall 14 connects the lateral walls 13 to be an annular shape.

Referring to FIGS. 3-4 and 8, the conductive terminals 2 are arranged in symmetry. Each row of conductive terminals 2 includes twelve terminals 2. Each conductive terminal 2 includes a contacting portion 21 extending into the front portion 102, a soldering portion 23 extending outwardly from a rear end of the insulative housing 1, and a fixed portion 22 connecting the contacting portion 21 and the soldering portion 23. The contacting portion 21 is used to contact the receptacle connector 200. The contacting portions 21 of the conductive terminals in two rows are allocated in reverse symmetry. The fixed portion 22 is affixed to the first groove 111 and exposed to the metal shell 5.

The locking member 3 includes a main portion 31 extending in the transverse direction and a pair of locking arms 32 extending forwardly and rearward from two ends of the main portion 31. The locking member 3 is received in the receiving room 10 from the rear opening 103 from a rear-to-front direction. The locking arms 32 are received in the third grooves 131 and each includes a bucking portion 321 protruding into the receiving room 10 in a front end and a soldering pin 322 in a rear end. The bucking portions 321 extend partially into the front portion 102. One of the soldering pins is located above the main portion 31 while the other is located under the main portion 31 making the soldering pins 322 clap a printed circuit board 300 along the vertical direction.

The locking member 3 is fixed by the insulator 4 and the insulative housing 1 altogether. The insulator 4 includes an insulative shell 41, a pair of extending portions 42 extending rearward from two lateral sides of the insulative shell 41, a number of through holes 40 penetrating the insulative shell 41 along the front-to rear direction and isolated in two rows in the vertical direction, and a number of convexes 43 extending forwardly from the insulative shell 41 and isolated in two rows along the vertical direction. The insulator 4 further includes a number of terminal grooves 44 communicating with the corresponded through holes 40 and each terminal groove 44 is formed between the adjacent convexes 43. The insulator 4 further includes a pair of mounting grooves 421 extending forwardly and rearward and located at the extending portion 42, a receiving groove 45 located between the convexes 43 in an upper row and the convexes 43 in a lower row, and a number of protrusions 411 located at an upper surface and a lower surface of the insulative shell 4. The insulator 4 is assembled to the insulative housing 1 along the rear-to-front direction making the main portion 31 of the locking member 3 received in the receiving groove 45. The size of the insulator 4 in the vertical direction is larger than that of the insulative housing 1 making the insulator 4 extending outwardly from the top wall 11 and the bottom wall 12. The conductive terminals 2 run through the insulative shell 41 by the corresponded terminal grooves 45 and the through holes 40.

The metal shell 5 is a closed structure with a sealing function and a better function of anti-electromagnetic interference. The metal shell 5 could be formed by metal injection molding, stainless stamped or others. The metal shell 5 includes a number of openings 50 located at an upper surface and a lower surface of a rear end and receiving the protrusions 411.

The plug connector 100 is an electrical USB Type-C connector. The grounding structure is cancelled in the plug connector 100 compared with the prior arts.

Referring to FIGS. 1 to 8, the receptacle connector 200 includes an insulative body 201, a number of mating terminals 202 affixed to the insulative body 201, a shielding plate 203 affixed to the insulative body 201, a sealing member 204 sealing a rear end of the insulative body 201, a shielding shell 205 enclosing the insulative body 201, and an outer metal shell 206 enclosing the shielding shell 205.

Figure 6:
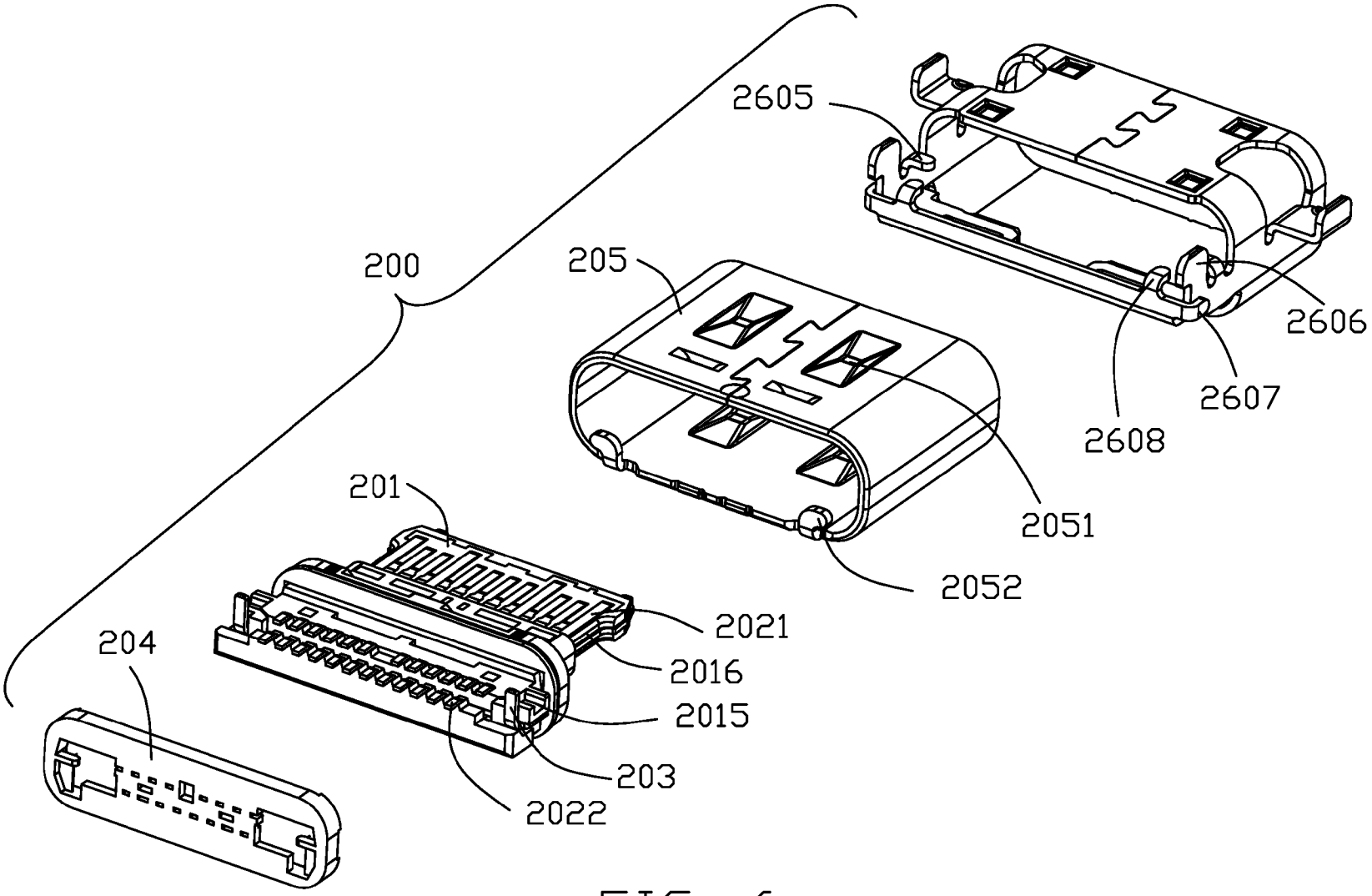
FIG. 6 is another exploded view of the receptacle connector taken from FIG. 5.
Figure 7:
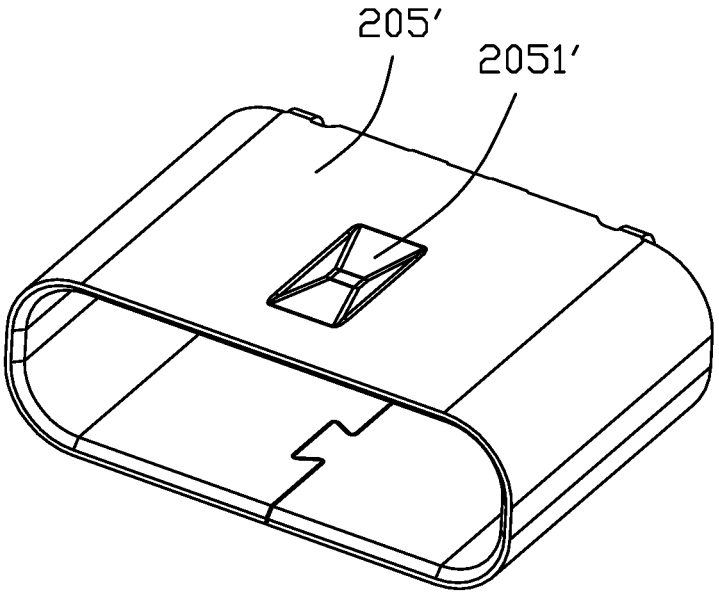
FIG. 7 is a perspective, assembled view of a shielding shell of the receptacle connector in another embodiment.

Referring to FIGS. 6 to 8, the insulative body 201 includes a base portion 2011, a tongue portion 2012 extending forwardly from the base portion 2011, a stepped portion 2017 connecting the base portion 2011 and the tongue portion 2012, and a installing portion 2013 extending rearward and horizontally. The tongue portion 2012 includes a pair of mating slots 2016 laterally mated with the locking member 3 of the plug connector 100. The size of the base portion 2011 in the vertical direction and the transverse direction is larger than that of the tongue portion 2012. The size of installing portion 2013 in the vertical direction is smaller than that of the base portion 2011 while the size in the transverse direction is large than that of the base portion 2011. The installing portion 2013 includes a number of penetrating holes 2014 communicating a top surface and a bottom surface, and a pair of bucking grooves 2015 located at two sides of the bottom surface of the installing portion 2013.

Each mating terminal 202 includes a contacting section 2021 exposed to an upper surface and a lower surface of the tongue portion 2012 and a soldering section 2022 extending outwardly from a rear end of the insulative body 201. The contacting sections 2021 are allocated in two rows in symmetry along the vertical direction. The soldering pins 2022 are allocated in two rows along the front-to-rear direction and positioned in the same plane. Each contacting section of the mating terminal 202 in the upper row is positioned in reverse symmetry with respect to a respective one of the other mating terminals in the lower row.

The sealing member 204 is insert-molding with the insulative body 201 and encloses an exposed portion of each mating terminal 202. The sealing member 204 seals the gap between the base portion 2011 and the shielding shell 205.

The shielding shell 205 includes a number of tubers 2051 protruding inward. The tubers 2051 is connected with the shielding shell 205 seamlessly. The tubers 2051 are located in front of the stepped portion 2017.

When the plug connector 100 is mated with the receptacle connector 200, the tubers 2051 resists against an outer surface of the metal shell 5 for a grounding function. Referring to FIG. 8, in other embodiments, the shielding shell 5' includes a tuber 2051' located at one of the upper surface and the lower surface of the shielding shell 205' to achieve grounding connection.

The outer metal shell 206 includes a main part 2061 as a cylindrical shape, a pair of soldering parts 2602 stamped stainless at two sides of the main part 2061, a baffle plate 2603 positioned horizontally and a pair of connecting portions 2604 bending downwardly and connecting the main part 2601 and the baffle plate 2603. The main part 2601 includes a pair of resisting portions 2605 extending downwardly and then horizontally, and a pair of fixing pins 2606 extending downwardly and then vertically. The fixing pins 2606 are located behind the resisting portions 2605. The resisting portions 2605 are stuck in the bucking grooves 2015. The baffle plate 2603 includes a pair of first positioning pins 2607 extending forwardly from two sides, and a pair of second positioning pins 2608 bending downwardly from the an end of the baffle plate 2603. The first positioning pins 2607 and the second positioning pins 2608 are fixed to the rear end of the insulative body 201. The first positioning pins 2607 resist against the fixing pins 2606 in corresponded making the baffle plate 2603 affixed to the main part 2601 and enhancing the strengthen of the baffle plate 2603. It is noted that as shown in FIG. 8, the tuber 2051 contacts the metal shell 5 at point A, the conductive terminal 2 contacts the mating terminal 202 at point B wherein in a side view on one hand point A is located between point B and the front edge E1 of the metal shell 5 in the front-to-back direction, and on the other hand point B is located between point A and the front edge E2 in the front-to-back direction. Notably, this arrangement is to provide a balanced situation for mating. Moreover, the tubular outer metal shell 206 forms a plurality inward protrusions 2069 to supportably abut against the shielding shell 205 wherein in a side view some inward protrusions 2069 correspond to point A and point B in the vertical direction.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector assembly comprising:

a plug connector comprising an insulative housing having locking arms, a plurality of conductive terminals arranged in two rows and affixed to the insulative housing, and a metal shell enclosing the insulative housing, the insulative housing comprising a top wall having a plurality of first grooves, and each of the conductive terminals comprising a fixed portion affixed to a corresponding first groove and exposed from the plurality of the first grooves; and a receptacle connector comprising an insulative body having a sealing member at a rear end thereof, a plurality of mating terminals affixed to the insulative body, a metallic shielding shell enclosing the insulative body, the shielding shell having a tuber extending inwardly;

wherein the tuber resists against a surface of the metal shell when the plug connector is mated with the receptacle connector;

the insulative housing comprises the top wall having the plurality of first grooves receiving the conductive terminals and an insulative wall located in front of the first grooves, a bottom wall having a plurality of second grooves receiving the conductive terminals and an insulative wall located in front of the second grooves, and a pair of lateral walls connecting the top wall and the bottom wall, the insulative wall being connected with the lateral walls and having a cylindrical shape;

the insulative body further comprises a base portion and a tongue portion, and the insulative wall of the top wall is located above the tongue portion and abuts the base portion when the plug connector is mated with the receptacle connector;

the shielding shell comprises an upper surface and a lower surface, the tuber is located at one of the upper surface and the lower surface, and the receptacle connector comprises only one tuber; and the receptacle connector comprises an outer metal shell enclosing the shielding shell, and the tuber is covered by a front end of the outer metal shell.

2. The electrical connector as claimed in claim 1, the shielding shell comprises an upper surface and a lower surface, the tuber is located at the upper surface and the lower surface.

3. The electrical connector assembly as claimed in claim 2, the receptacle connector comprises a pair of tubers arranged in a transverse direction, and the tubers extend in a front-to-rear direction perpendicular to the transverse direction.

4. The electrical connector assembly as claimed in claim 1, the tuber is located at one of a front end, a middle part, and a rear end of the shielding shell.

5. The electrical connector assembly as claimed in claim 1, the tuber is connected with the shielding shell seamlessly.

6. The electrical connector assembly as claimed in claim 1, the insulative body comprises a base portion, a tongue portion, and a stepped portion connecting the base portion and the tongue portion, and the tuber is located in front of the stepped portion.

7. An electrical connector assembly comprising:

a plug connector including:

an insulative housing having locking arms;

a plurality of conductive terminals arranged in two rows and affixed to the insulative housing, and a metal shell enclosing the insulative housing, the insulative housing comprising top and bottom walls each of the walls having a plurality of grooves, and each of said conductive terminals comprising a fixed portion affixed to a corresponding grooves and exposed from the plurality of the grooves; and a receptacle connector comprising an insulative body having a sealing member at a rear end thereof, a plurality of mating terminals affixed to the insulative body, and a metallic shielding shell enclosing the insulative body, the metallic shielding shell having a tuber extending along a front-to-back direction and protruding inwardly in a vertical direction perpendicular to said front-to-back direction, a tubular outer metal shell surrounding the metallic shielding shell and protecting covering most portions of said tuber in the vertical direction; wherein the tuber abuts against a surface of the metal shell when the plug connector is mated with the receptacle connector in the vertical direction;

wherein the tuber contacts the metal shell of the plug connector at a first point, each of the conductive terminals contacts the corresponding mating terminal at a second point, and second point is located between the first point and a front edge of the tubular outer metal shell in the front-to-back direction;

wherein the front edge of the tubular outer metal shell is located between the second point and a front edge of the metallic shielding shell of the receptacle connector in said front-to-back direction;

wherein the tubular outer metal shell forms an inward protrusion to abut against a surface of the metallic shielding shell, and in a side view said inward protrusion essentially extends along the front-to-back direction with a distance to correspond to both the first point and the second point in said vertical direction.

8. The electrical connector assembly as claimed in claim 7, wherein the first point is located between the second point and a front edge of the metal shell of the plug connector in the front-to-back direction.

* * * * *